US006958563B2

(12) United States Patent
Hockaday et al.

(10) Patent No.: US 6,958,563 B2
(45) Date of Patent: Oct. 25, 2005

(54) RISER COMMUTATORS

(75) Inventors: Shepard Lynn Hockaday, Benson, NC (US); Pimol Ballard Vonkchalee, Raleigh, NC (US); Winford Lee Stephens, Dunn, NC (US); Danny Earl Thornton, Coats, NC (US); Robert Eugene Jenkins, Jr., Oak Island, NC (US)

(73) Assignee: Energy Conversion Systems Holdings, LLC, Dunn, NC (US)

( * ) Notice: Subject to any disclaimer, the term of this patent is extended or adjusted under 35 U.S.C. 154(b) by 166 days.

(21) Appl. No.: 10/346,525

(22) Filed: Jan. 16, 2003

(65) Prior Publication Data

US 2004/0139595 A1 Jul. 22, 2004

(51) Int. Cl.[7] ..... H01R 39/04

(52) U.S. Cl. ..... 310/233; 310/273; 428/582; 428/583

(58) Field of Search ..... 428/577, 583, 428/585, 595, 600, 582; 310/233, 273

(56) References Cited

U.S. PATENT DOCUMENTS

| | | | | | |
|---|---|---|---|---|---|
| 1,357,016 | A | * | 10/1920 | Zimmerman | 310/233 |
| 1,364,182 | A | * | 1/1921 | Conkling | 52/740.2 |
| 2,858,695 | A | * | 11/1958 | Loughborough | 52/396.02 |
| 3,090,840 | A | * | 5/1963 | Dehn | 191/23 A |
| 3,091,024 | A | * | 5/1963 | Poux | 29/410 |
| 3,122,820 | A | * | 3/1964 | Arnold | 29/598 |
| 4,388,751 | A | * | 6/1983 | Fukuroi | 29/410 |
| 4,638,202 | A | | 1/1987 | Ebner | |
| 4,692,648 | A | * | 9/1987 | Knoerzer | 310/233 |
| 4,890,377 | A | | 1/1990 | Ebner | |
| 5,008,778 | A | * | 4/1991 | Peyerl | 361/800 |
| 5,671,510 | A | * | 9/1997 | Maeda et al. | 24/408 |
| 6,539,598 | B1 | * | 4/2003 | Weber | 29/11 |
| 2003/0192150 | A1 | * | 10/2003 | Aoki et al. | 24/403 |

FOREIGN PATENT DOCUMENTS

| | | | |
|---|---|---|---|
| EP | 0379664 | * | 8/1990 |
| FR | 2504318 | | 10/1982 |
| FR | 2532789 | | 9/1984 |
| WO | WO 99/55993 | * | 11/1999 |

OTHER PUBLICATIONS

Derwent Abstract for FR 2532789, Mar. 9, 1984, one page.*
Derwent Abstract for FR 2504318, Oct. 22, 1982, one page.*
European Search Report dated Jul. 2, 2004.
European Search Report dated Sep. 14, 2004.

* cited by examiner

*Primary Examiner*—John J. Zimmerman
(74) *Attorney, Agent, or Firm*—McCarter & English LLP

(57) ABSTRACT

Rotary switches, and in particular riser-style commutators, are detailed together with featured strips from which they are made. Segments formed from the strips may include anchor notches and slots for receiving reinforcing rings. The structure of the strip additionally permits electrical isolation of adjacent riser segments to occur through its coining rather than through slotting.

12 Claims, 7 Drawing Sheets

RISER COMMUTATORS

This invention relates to rotary switches and more particularly to (riser) commutators used in connection with electric motors.

BACKGROUND OF THE INVENTION

Many existing commutators, high-speed rotary switches typically used with electric motors, comprise multiple copper segments arranged into a cylinder and anchored into a non-conducting (often phenolic) molding compound. Each segment is physically separated and electrically isolated from those adjacent to it, so that an electrical brush passing along the outer diameter of the cylinder will form a conductive path only with the segment (or segments) in contact with it at any given instant. The commutators additionally permit ends of an armature to be connected thereto.

U.S. Pat. Nos. 4,638,202 and 4,890,377 to Ebner (collectively the "Ebner patents"), incorporated herein in their entireties by this reference, illustrate and disclose examples of so-called "riser"-style commutators. As noted in the Ebner patents, a "disk-like riser plate is molded at one end of the commutator with slots for receiving and holding the coil ends of an appropriate motor armature in engagement with respective ones of the commutator segments." Such slots are positioned intermediate protrusions designated as "risers."

Described in the Ebner patents are conventional methods of manufacturing riser commutators. According to the patents:

> In somewhat larger commutator assemblies, each commutator segment is individually formed as a bar-like element. A composite riser means is formed at one end of the commutator, including a riser portion for each commutator bar . . . . The risers are formed by machining down the commutator bars to form radially extending flanges at one end of the commutator . . . .

Also detailed in the Ebner patents is an alternate method of manufacturing riser commutators. As noted therein:

> The riser means . . . is fabricated in the form of a molded disk-like plate at the end of the commutator facing the motor. The plate is thereby separate or independent of [the] commutator segments. The riser plate is molded with locating or anchoring means in the form of a plurality of peripheral slots for receiving and holding the coil ends of the motor armature.

(Numerals omitted.) According to the Ebner patents, the riser plate may be molded either as an integral part of an insulating core of a commutator or to the core and segments.

Yet another commutator-forming method currently in use involves cold-forming a copper rod into a ring and then forcing a portion of the rod to extrude into an elongated shape. Various faces of this preform must then be ground and the preform slotted to provide appropriate electrical isolation. Phenolic insulating material is thereafter molded to the preform to form the insulating core of the resulting commutator and the ring punched to form alternating slots and risers.

Numerous difficulties exist in forming riser-style commutators in this manner. Because of tooling limitations, for example, bars or segments of these commutators often lack effective anchoring, contributing to earlier-than-desirable failure of the structures. Inability to provide anchoring into the riser heads of the commutators for the bars likewise may contribute to structural failures when commutators are made in this fashion.

SUMMARY OF THE INVENTION

The present invention provides alternate designs of switches and commutators and innovative methods of manufacturing them. Unlike the commutators detailed in the preceding paragraph, those of the present invention permit substantial anchoring of bars and commutator riser heads.

Additionally included as an aspect of the present invention is the structure of the base strip of material from which portions of the commutators are formed. Although not all of the features of the strip are necessarily wholly functional, some clearly have useful purposes. As but one example, the structure of the base strip allows segment isolation to be accomplished through coining (rather than slotting). Exemplary base strips additionally may, for example, include locator guides for creating slots between risers. Further, because segments are blanked or otherwise cut from the base strip, they may include anchor notches as well. Likewise, if reinforcing rings are employed in the commutator design, the segments may incorporate these anchor notches for receiving such rings.

Manufacture of such an exemplary commutator proceeds with blanking a series of bar-containing segments from the featured base strip. Integral with each bar is a head from which slots and risers will be formed. Segments may then be assembled into a preform, with reinforcing rings or other devices used to maintain the integrity of the preform either temporarily or permanently. Phenolic or other electrically-non-conducting material may be molded to the preform, followed by boring or turning of the assembly as needed or desired. Thereafter, slots may be formed in the head using the locator guides, hence creating risers intermediate the slots.

It thus is an optional, non-exclusive object of the present invention to provide innovative rotary switches.

It is an additional optional, non-exclusive object of the present invention to provide novel base strips from which rotary switches may be formed.

It is another optional, non-exclusive object of the present invention to provide techniques for forming rotary switches from the novel base strips.

Other objects, features, and advantages of the present invention will be apparent to those skilled in the appropriate art with reference to the drawings and remaining text of this application.

DETAILED DESCRIPTION

Figure 1:
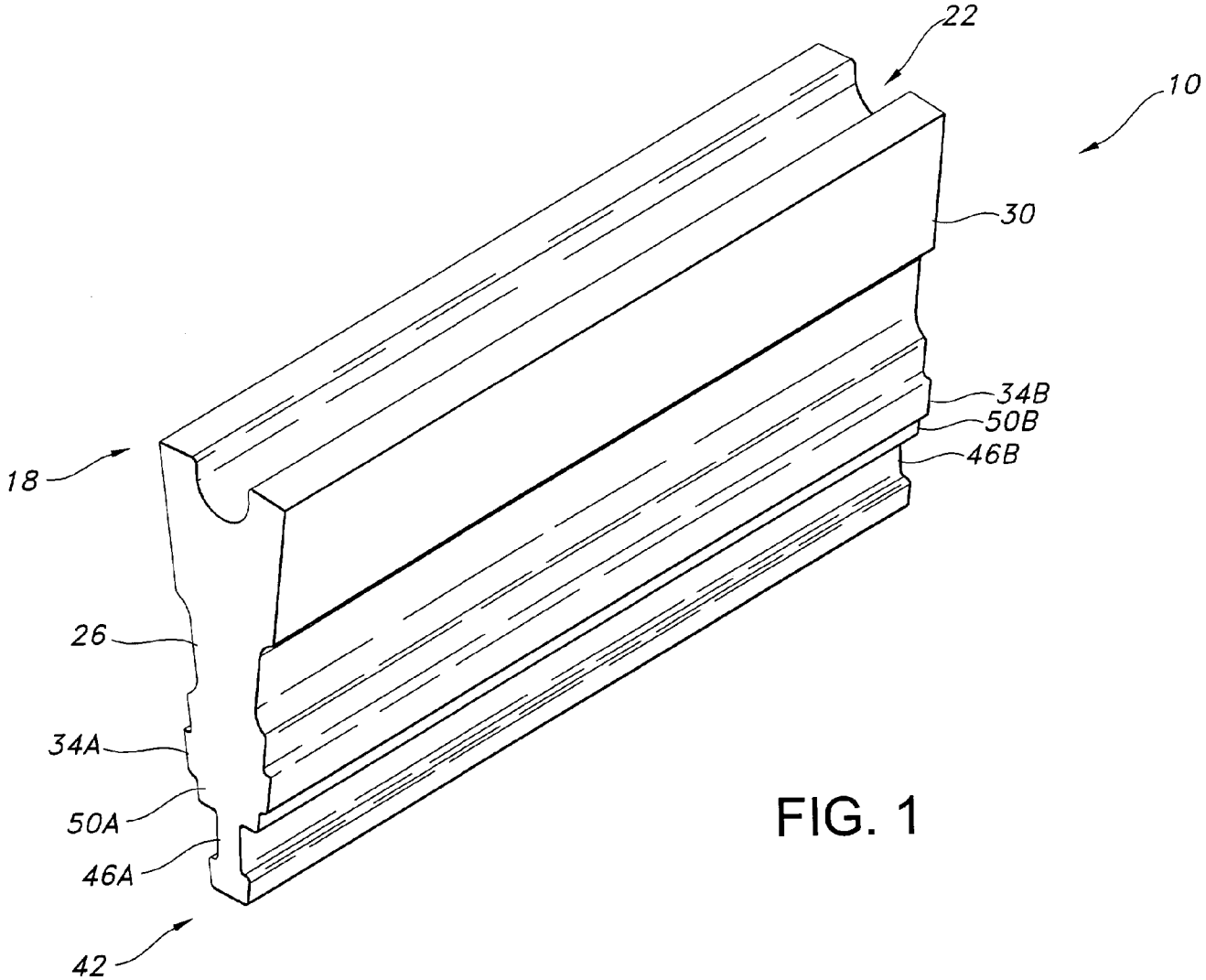
FIG. 1 is a perspective view of a base strip of the present invention.
Figure 2:
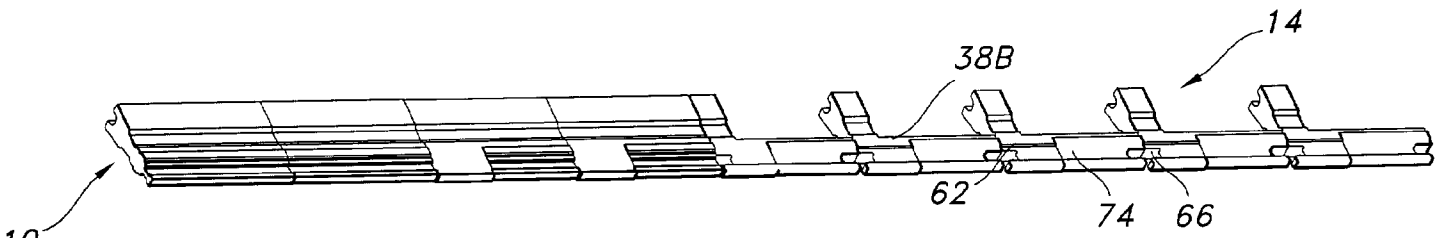
FIG. 2 is a view of an elongated version of the base strip of FIG. 1 illustrating a segment blanked therefrom.

FIGS. 1–2 illustrate an embodiment of base strip 10 of the present invention. As depicted therein, strip 10 is a multi-featured material from which bars such as segment 14 (FIG. 3) are formed. Included at first end 18 of strip 10 is riser guide 22, designed to facilitate formation of slots between risers into which armature wires may be connected. Alternatively, riser guide 22 may be pre-formed to the depth of such slots, so that no further machining of strip 10 is necessary.

Sides 26 and 30 of strip 10 may include protruding chords 34A and 34B, respectively. As depicted in FIG. 2, periodic portions of chord 34B may be coined (or otherwise compressed or removed) so as to form recessed areas 38B (see also FIG. 3). Chord 34A may be acted upon similarly to form periodic recessed areas in it. Collectively, these recessed areas assist in isolating adjacent segments 14 electrically in a finished commutator, as they prevent the segments 14 from contacting in these areas. Although preferably recessed areas are formed in both chords 34A and 34B, those skilled in the art conceivably could manufacture a commutator in which only one of chords 34A or 34B is recessed for any particular segment 14. Likewise, those skilled in the art will recognize that the recesses may be formed in any suitable manner, including by building chords 34A and 34B onto respective sides 26 and 30 rather than removing or moving material therefrom.

Second end 42 of strip 10 features recessed areas 46A and 46B and is designed ultimately to help anchor segments 14 within an insulating core of a commutator. The version of strip 10 illustrated in FIGS. 1–2 additionally features shoulders 50A and 50B, with shoulder 50A positioned intermediate chord 34A and recessed area 46A and shoulder 50B positioned between chord 34B and recessed area 46B. As discussed later, however, presently-preferred embodiments of strip 10 omit such shoulders 50A and 50B. Many embodiments of strip 10 nevertheless maintain the generally Y-shaped cross-section visible in FIG. 1 and preferably (but not necessarily) are created using a conforming die process.

Figure 3:
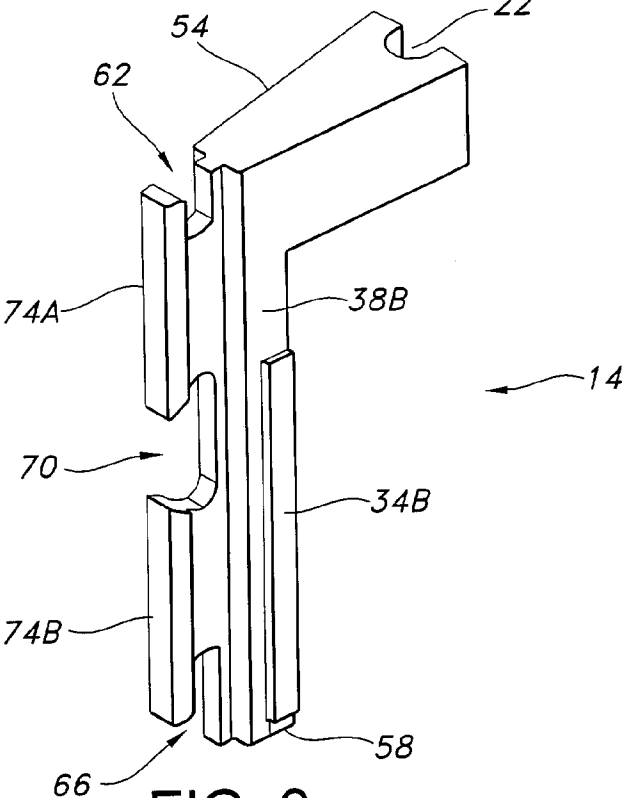
FIG. 3 is a perspective view of the segment of FIG. 2.

Consistent with FIGS. 2–3, segments 14 may be punched, blanked, or otherwise individually formed from strip 10. The segment 14 depicted in FIG. 3 includes integral head 54 and bar 58, with one positioned largely perpendicular to the other. Although aspects of the present invention remain achievable regardless of whether head 54 and bar 58 are integrally formed, such integral formation is advantageous in many performance-related respects. Similarly, head 54 and bar 58 need not necessarily be perpendicular, although having them be so (or substantially so) may often be beneficial.

Illustrated in FIGS. 2–3 are anchor notches 62 and 66 in bar 58, preferably (but not necessarily) created when each segment 14 is formed. Each of anchor notches 62 and 66 is adapted to receive a reinforcing ring to enhance stability of the resulting commutator. Use of such reinforcing rings is, however, optional, and either or both of anchor notches 62 and 66 may be omitted if desired.

Although not shown in FIG. 2, detailed in FIG. 3 is slot 70, formation of which divides anchoring portion 74 of bar 58 into anchors 74A and 74B. As disclosed later herein, anchors 74A and 74B may be embedded, in whole or in part, in the core of the resulting commutator for stability-enhancement purposes. If present, slot 70 preferably (although again not necessarily) is created when each segment 14 is formed from strip 10.

Figure 4B:
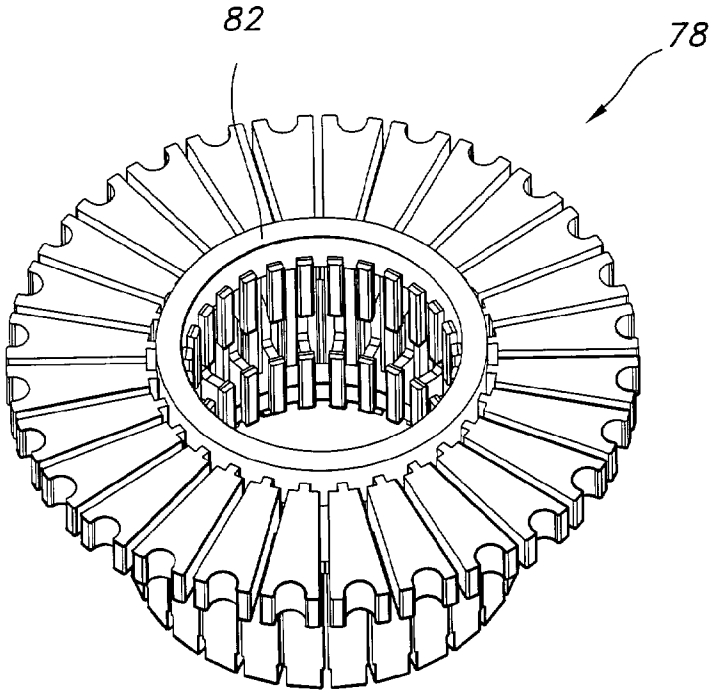
FIGS. 4A–B are perspective views of a preform made of multiple segments of the type shown in FIG. 3.
Figure 4A:
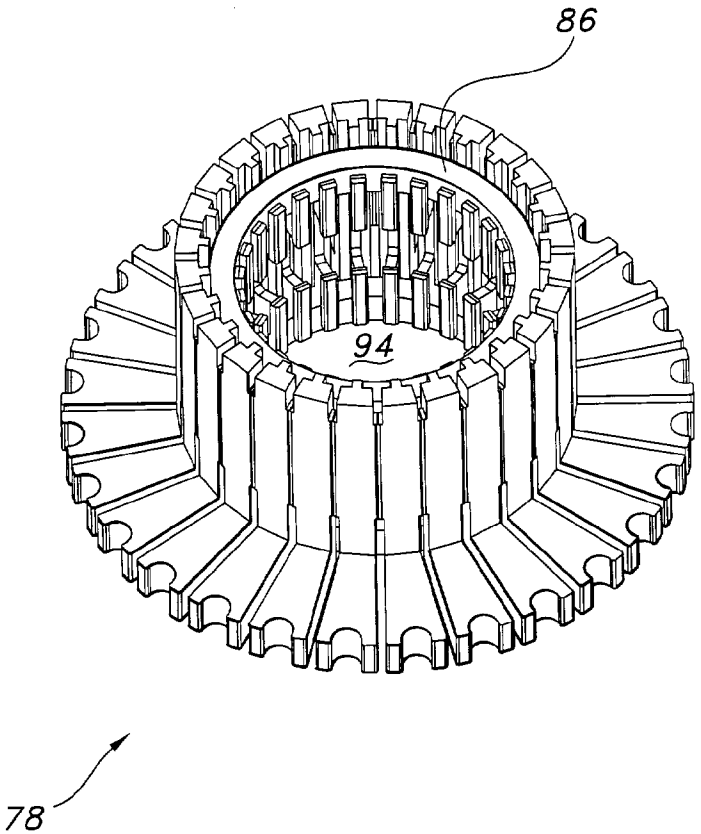

FIGS. 4A–B illustrate sets of segments 14 assembled, effectively side-by-side, into preform 78. Also shown in FIGS. 4A–B are reinforcing rings 82 and 86, the former received by anchor notches 62 of the assembled segments 14 and the latter received by anchor notches 66. Rings 82 and 86, when utilized, may function both temporarily (to maintain the assembly of segments 14 into preform 78) and permanently (to enhance the stability of the resulting commutator).

Figure 5:
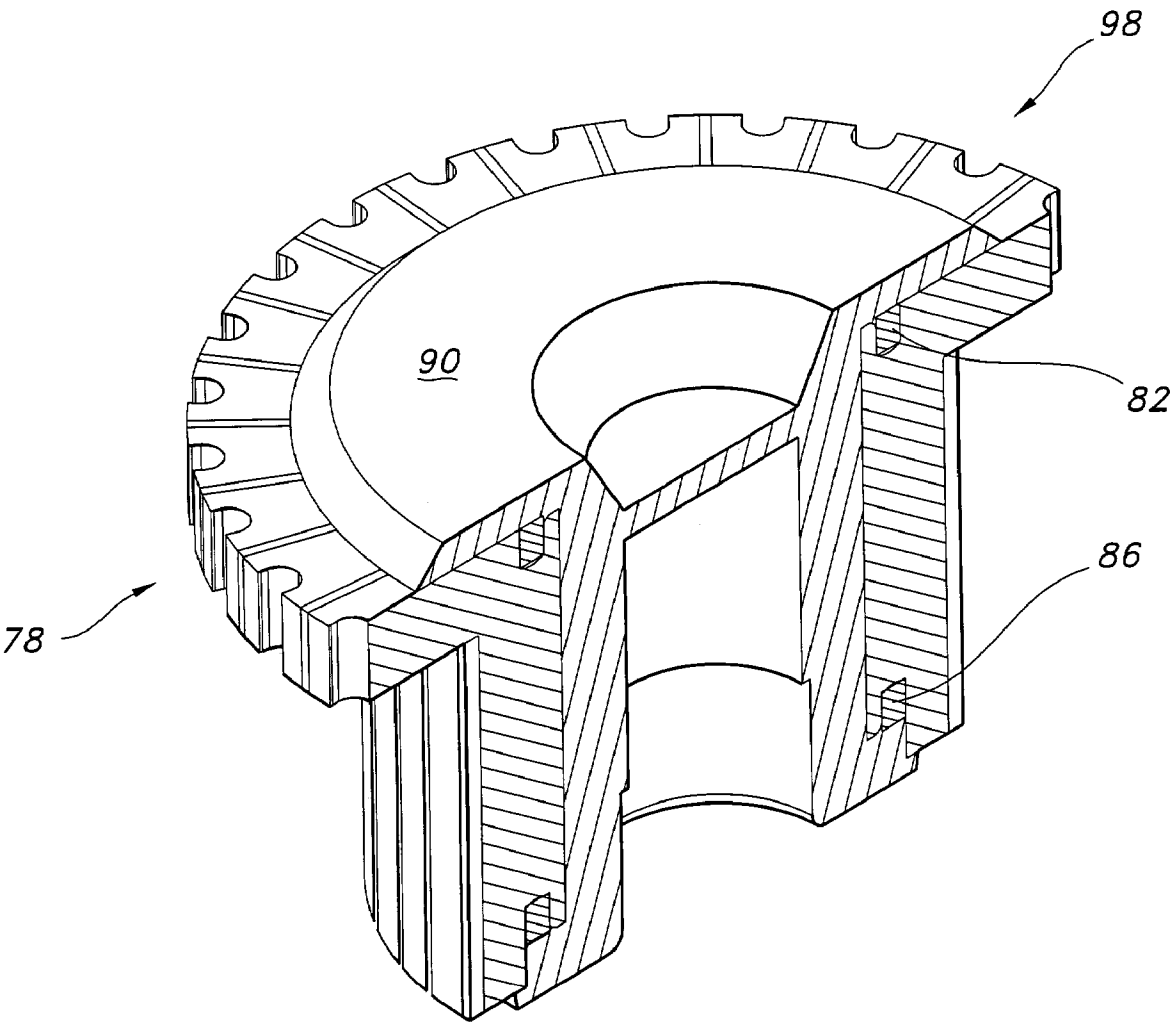
FIG. 5 is a perspective, partially cut-away view of the preform of FIGS. 4A–B with an insulating core molded therein.
Figure 6:
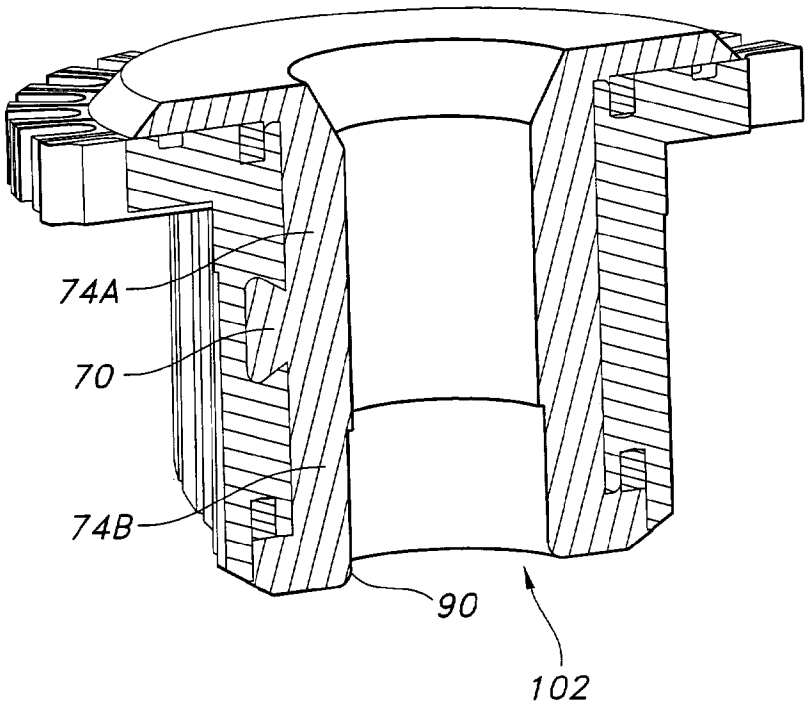
FIG. 6 is a perspective, partially cut-away view of the preform and core of FIG. 5 following boring and turning.

Core 90 (FIG. 5) thereafter may be molded into opening 94 of preform 78. Core 90 typically is made of electrically-insulating material. Although preferably phenolic, such material need not necessarily be so, and those skilled in the art will understand that other materials may be used instead in appropriate circumstances. Regardless of the material chosen, however, conventional molding techniques may be employed. The consequence of the operation is an assembly 98 in which both the segments 14 and rings 82 and 86 of preform 78 are embedded, and thereby anchored, in the material of core 90. FIG. 6 especially illustrates anchoring of segments 14, depicting material of core 90 having entered slot 70 between anchors 74A and 74B. Also shown in FIG. 6 is bore 102, which extends centrally through assembly 98 and facilitates mounting the finished commutator on a shaft for use.

Figure 7:
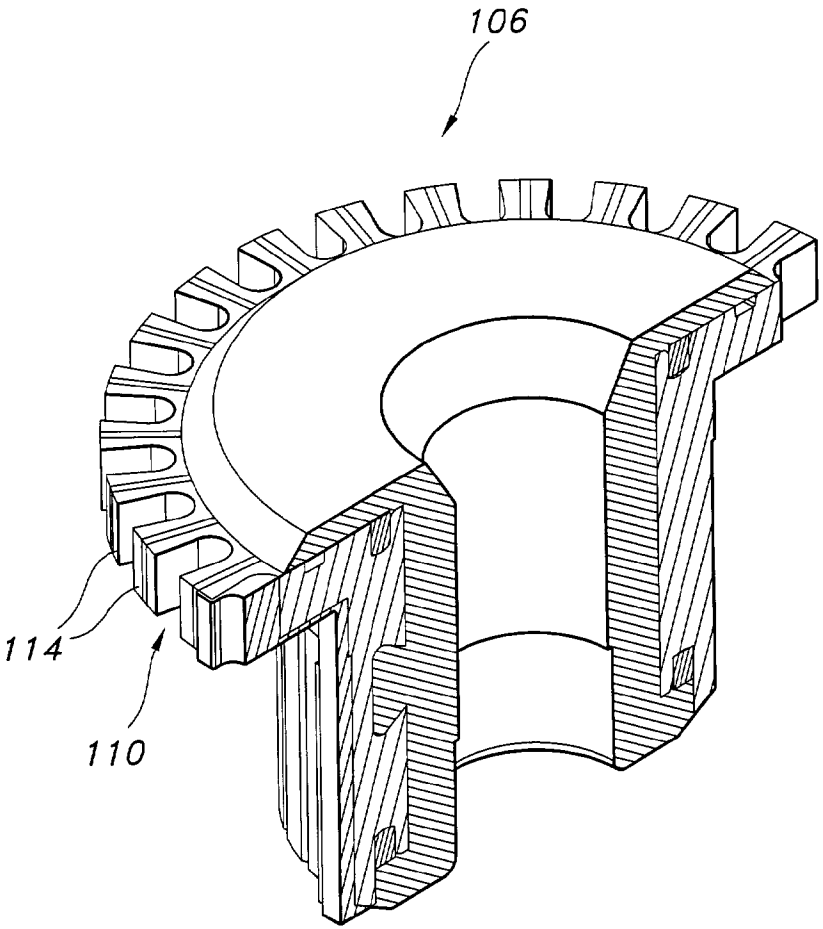
FIG. 7 is a perspective, partially cut-away view of the preform and core of FIG. 6 shown as slotted to form an exemplary riser commutator.

FIG. 7, finally, illustrates one example of a finished commutator 106. To produce commutator 106 from assembly 98, guides 22 are increased in width and depth to form riser slots 110 intermediate risers 114. Armature wires may then be fused, or otherwise connected, to selected riser slots 110. Bars 58 additionally may be slotted to increase their physical separation and enhance electrical isolation.

Figure 12:
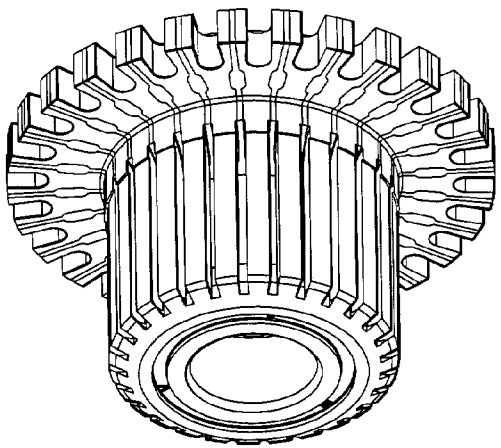
FIG. 12 is a perspective view of a riser commutator formed from the preform of FIG. 11.
Figure 9:
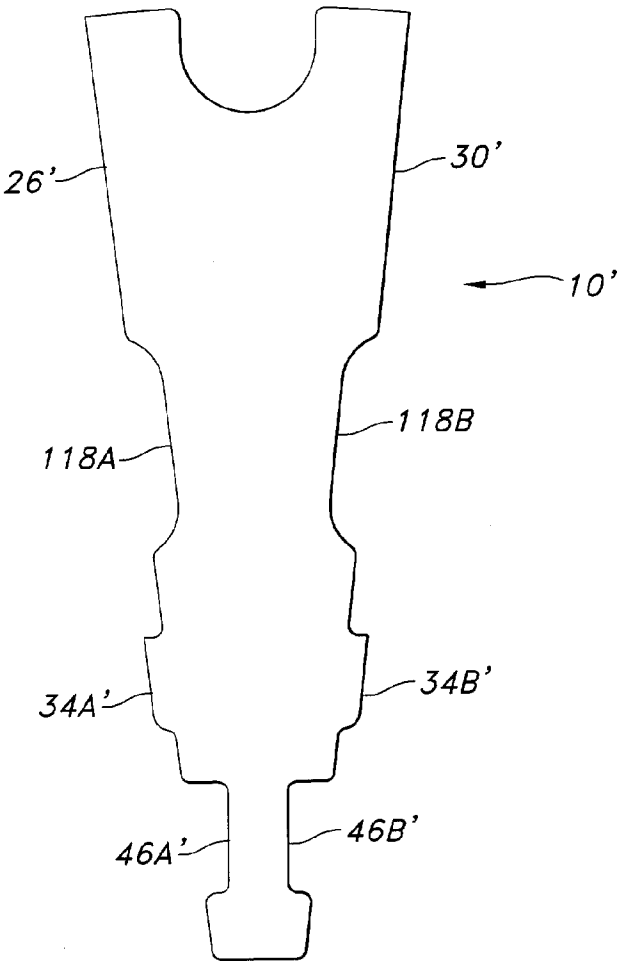
FIG. 9 is an end view of the base strip of FIG. 8.
Figure 8:
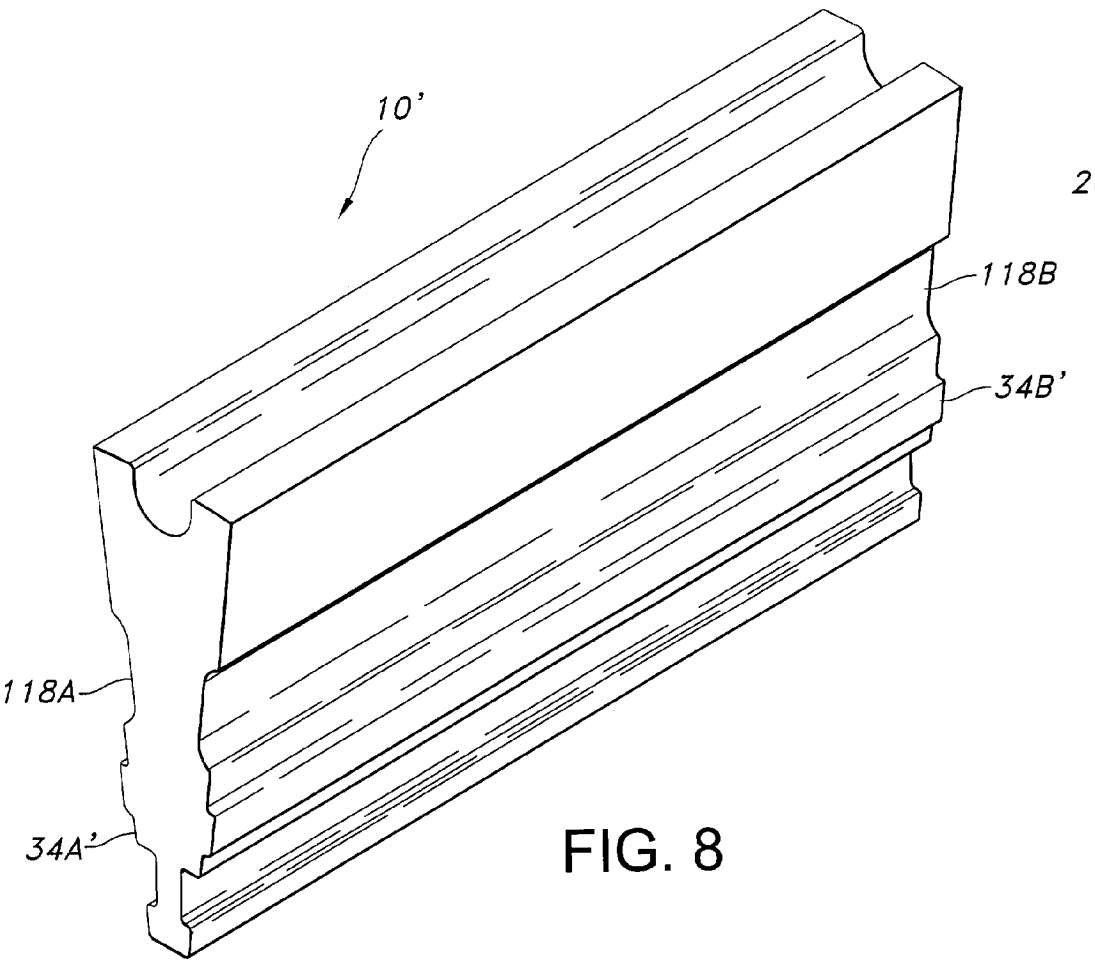
FIG. 8 is a perspective view of an alternate base strip of the present invention.
Figure 10:
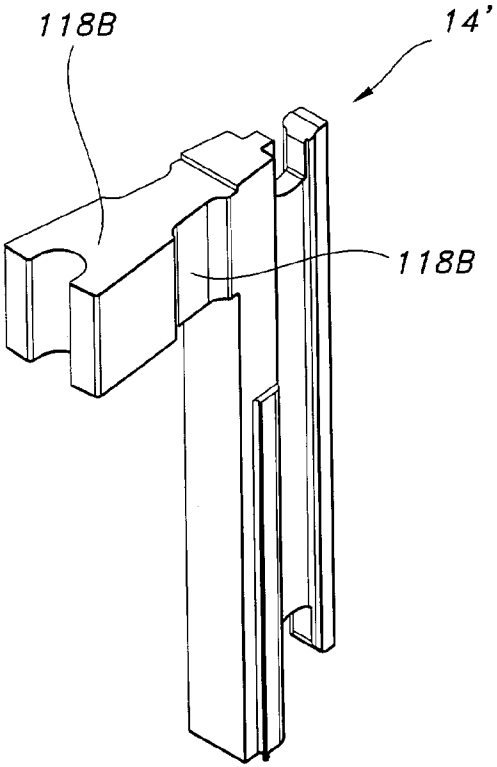
FIG. 10 is a perspective view of a segment created from the base strip of FIG. 8.
Figure 11:
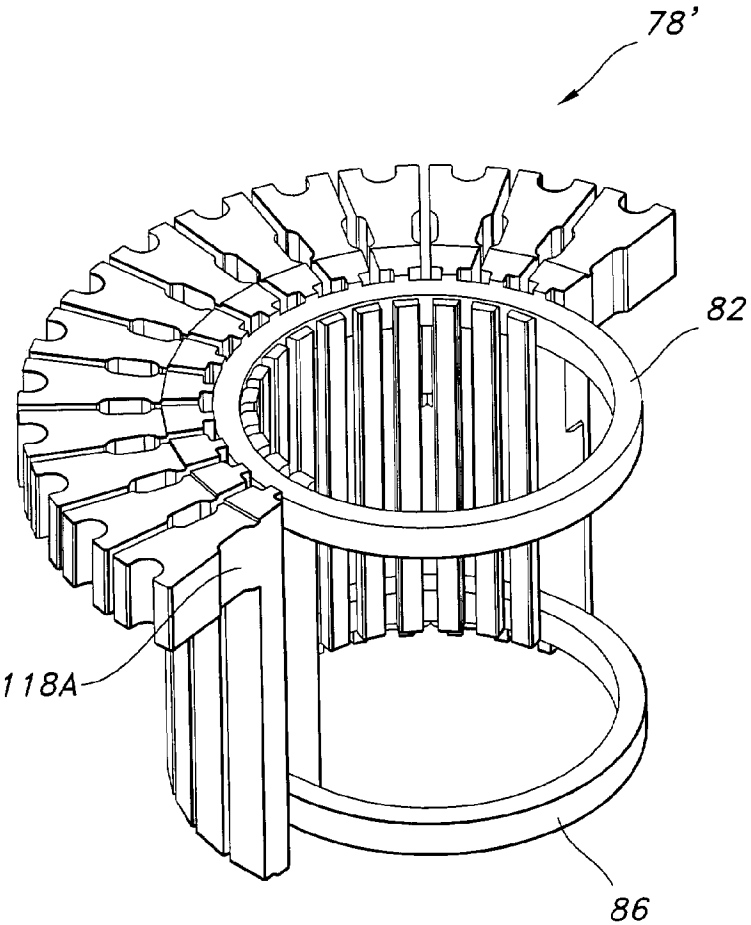
FIG. 11 is a partially-sectioned view of a preform made of multiple segments of the type shown in FIG. 10.

FIGS. 8–9 depict an alternate strip 10'. Presently preferred, strip 10' is substantially similar to strip 10 and, as appears in FIG. 9, maintains a generally Y-shaped cross-section. However, unlike strip 10, strip 10' includes riser head notches 118A and 118B in sides 26' and 30', respectively. As shown in FIG. 12, riser head notches 118A–B may be filled with the material of core 90, further anchoring the heads of the corresponding segments. These skilled in the art will recognize that notches—or other anchoring devices—may be placed on or in faces of strip 10' other than sides 26' and 30' instead. FIG. 10 depicts a segment 14' created from strip 10', while FIG. 11 illustrates a preform 78' assembled from multiple segments 14'.

Advantages of the present invention reside not only in finished commutators, but also in the starting materials for such commutators and the methods in which they are made. Utilizing a strip of base material rather than, for example, a rod permits the strip to include the many beneficial features described earlier in this application. Forming individual segments by blanking (instead of, for example, extruding them collectively and then slotting the result to achieve electrical isolation) further allows formation of anchoring devices such as, but not limited to, riser head notches 118A or 118B, particularly for the head of each segment. Blanking the segments also permits use of reinforcing rings with riser commutators, which is unconventional, and allows electrical isolation to be aided by coining portions of chords of the base strips. Additionally, the present invention avoids any need to extrude metallic material or to grind its faces.

Because of these innovative designs, exemplary commutators of the present invention outperform existing commercial products in many respects. For example, some embodiments of the present invention have shown greater than twenty-five percent improvement in spin-to-destruct capability when compared to an existing commercial riser commutator. Other tests similarly indicate that bar-separation force for commutators of the present invention is approximately three times greater than the force needed to separate bars of the existing commercial product. Moreover, the wear depth of commutators of the present invention is approximately one-third greater than for the existing commercial product.

Hence, the foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. A strip of electrically-conducting material for a commutator assembly comprising:

a first end and a second end;

a first length that extends between the first end and the second end;

an extension extending outward from the first length to a third end, the extension has a second length, the extension being sized so as to be assembled in the commutator assembly; and a first chord protruding from a first side of the extension and extending along a portion of the second length, the first chord includes a recessed area formed adjacent to the first chord and extending along a remaining portion of the second length, the recessed area is sized so as to electrically insulate the strip from an adjacent strip in the commutator assembly; and an indented area extending along the second length and parallel to the first chord and the recessed area, the indented area being sized so as to anchor the strip within the commutator assembly.

2. The strip of claim 1, further comprising a recess area located at the first end and along the first side of the extension.

3. The strip of claim 2, wherein the recess area includes an anchor notch formed at the first end, the anchor notch is sized to receive a reinforcing ring.

4. The strip of claim 2, wherein the recess area includes an additional recess area located along a second side of the extension.

5. The strip of claim 2, wherein the recess area includes an anchor notch formed at the third end, the anchor notch is sized to receive a reinforcing ring.

6. The strip of claim 2, wherein the recess area includes an anchor notch formed at the first end, the anchor notch is sized to receive a reinforcing ring.

7. The strip of claim 2, wherein the extension includes a shoulder that is positioned between the first chord and the recess area.

8. The strip of claim 1, further comprising a slot formed approximately midway between the first end and the third end so as to form a first anchor and a second anchor.

9. The strip of claim 1, further comprising a riser guide formed at the second end.

10. The strip of claim 1, further comprising a second chord protruding from a second side of the extension and extending along the first portion of the second length, the second chord includes an indented area, the indented area extending along the second portion of the second length and being sized so as to electrically insulate the strip from an adjacent strip in the commutator assembly.

11. The strip of claim 1, wherein the extension includes an open area so that the first length and the second length form an integral head and bar that are positioned approximately perpendicular to each other.

12. A strip of electrically-conducting material for a commutator assembly comprising:

a first end and a second end;

a first length that extends between the first end and the second end; and an extension extending outward from the first end of the first length to a third end, the extension has a second length, the extension being sized so as to be assembled in the commutator assembly, the extension having an indented area and being sized so as to mount the strip in the commutator assembly, wherein the first length includes at least one notch formed adjacent to the extension and parallel to the second length.

* * * * *